US007581951B2

(12) United States Patent
Lehmann et al.

(10) Patent No.: US 7,581,951 B2
(45) Date of Patent: Sep. 1, 2009

(54) DENTAL TREATMENT ELEMENT

(75) Inventors: Karl-Heinz Lehmann, Bensheim (DE); Peter Frey, Frankenthal (DE)

(73) Assignee: Sirona Dental Systems GmbH, Bensheim (DE)

( * ) Notice: Subject to any disclaimer, the term of this patent is extended or adjusted under 35 U.S.C. 154(b) by 57 days.

(21) Appl. No.: 10/562,939

(22) PCT Filed: Jul. 1, 2004

(86) PCT No.: PCT/EP2004/051321

§ 371 (c)(1),
(2), (4) Date: Dec. 30, 2005

(87) PCT Pub. No.: WO2005/002489

PCT Pub. Date: Jan. 13, 2005

(65) Prior Publication Data

US 2006/0166165 A1 Jul. 27, 2006

(30) Foreign Application Priority Data

Jul. 1, 2003 (DE) ..... 103 29 802

(51) Int. Cl.
*A61G 15/00* (2006.01)

(52) U.S. Cl. ..... 433/77; 433/28; 433/49; 433/78; 433/79; 312/209

(58) Field of Classification Search ..... 433/77–79, 433/49, 28, 29, 33, 108–109; 312/209
See application file for complete search history.

(56) References Cited

U.S. PATENT DOCUMENTS

| | | | | | |
|---|---|---|---|---|---|
| 3,823,475 | A | * | 7/1974 | Heubeck | 433/33 |
| 4,106,198 | A | * | 8/1978 | Childress | 433/28 |
| 4,359,316 | A | * | 11/1982 | Kummel et al. | 433/79 |
| 4,952,146 | A | * | 8/1990 | Doty | 433/77 |
| 4,976,616 | A | * | 12/1990 | Eisner et al. | 433/77 |
| 5,127,830 | A | * | 7/1992 | Sheridan et al. | 433/77 |
| 5,297,961 | A | * | 3/1994 | Hanson | 433/77 |
| D349,162 | S | * | 7/1994 | Nordstrom et al. | D24/177 |
| 5,332,392 | A | * | 7/1994 | Bierbaum et al. | 433/77 |
| 5,334,018 | A | * | 8/1994 | Young | 433/77 |
| D351,231 | S | * | 10/1994 | Austin et al. | D24/177 |
| 5,807,521 | A | * | 9/1998 | Franetzki | 422/20 |

FOREIGN PATENT DOCUMENTS

| | | |
|---|---|---|
| DE | 2453519 | 5/1975 |
| DE | 2657675 | 6/1978 |

* cited by examiner

*Primary Examiner*—Cris L Rodriguez
*Assistant Examiner*—Michael R Ballinger
(74) *Attorney, Agent, or Firm*—Dykema Gossett PLLC

(57) ABSTRACT

The invention relates to a treatment element which is used to receive dental hand instruments. Said treatment element comprises a base part (1) which is provided with connections (2; 39) and which is used to accommodate the instruments, and a instrument storage place (5; 15). Said treatment element comprises an exchangeable upper part (4; 12).

17 Claims, 6 Drawing Sheets

DENTAL TREATMENT ELEMENT

TECHNICAL FIELD

The invention relates to a dental treatment element, on which hand instruments required for carrying out dental treatment are mounted. The treatment element contains all of the components necessary for the supply of electric current and media to the instruments, which are connected to the treatment element via supply conductors or supply hoses.

DE 197 02 996 C1 discloses a dental treatment element which has hanging instrument hoses. The instruments are held in docking bays, and the instrument hoses hang in a loop below the treatment element.

DE 196 30 349 C1 discloses a treatment element in which the instrument hoses are guided over the treatment element. Such a device is known as a "whip-arm hose support unit". The instruments are docked in troughs that are provided for this purpose in the front region of the treatment element, the hoses being guided by so-called whip arms over the treatment element and are likewise fixed to the treatment element or connected thereto via a quick coupler.

The term "treatment element" is to be understood as including both dentist's elements and chair assistant's elements. These elements are also known as "dentist's apparatus" or "assistant's apparatus".

Both types of apparatus allow for different ways of handling the instruments, the decisive factor being the position of the treatment element with reference to the patient. Both variants have advantages and disadvantages so that both types of apparatus are used.

When two or more persons use the treatment element, the situation can occur in which one of the users will want to work with the type of apparatus other than that being currently used.

Since dental work places are designed to comply with the treatment routines of the respective users, a separate work place must be appropriately provided for each of a number of users working to a different treatment routine.

SUMMARY AND OBJECTS OF THE INVENTION

Using a treatment element having the features defined in claim 1, it is possible to make the dental work place conform to the opus moderandi of the user by altering the design of the treatment element.

The treatment element for the accommodation of dental hand instruments comprises a base module having connectors for the supply of media to the instruments and also a top module having an instrument holder, the top module being interchangeable and the base module being convertible, by changing the top module, from the type of apparatus with hanging instrument hoses to a whip-arm hose support type of apparatus According to one advantageous development, the interchangeable top module is fixed to the base module in such a manner that it can be removed therefrom without the assistance of tools, in order to convert the treatment element. For this purpose the top module can be disconnected by hand.

Only the functional parts such as the holder for the instruments and the whips need to be altered, the remaining structural portion of the base module being unchanged.

All possible treatment events can be effected using only one treatment element, since the simple and fast on-the-spot conversion of the treatment element enables the user to change from an element having whip-arm hose supports to one comprising apparatus with hanging instrument hoses.

Advantageously, the connectors for the supply of media to the instruments are disposed on the underside of the base module. These connectors can be in the form of releasable couplings.

According to a further embodiment, the top module is equipped with a control panel, and in this case the control panel is connected to the base module via signal-conducting lines.

Advantageously, the top module is equipped with an instrument holder in the form of a separate component. By this means the instrument holder, which is more prone to contamination, can be removed and sterilized without any difficulty.

Advantageously, one embodiment of the top module and the instrument holder is designed for the accommodation of instruments with hanging instrument hoses. Furthermore, the top module can include a flat receptacle and the instrument holder can include docking bays for holding the instruments.

According to a further embodiment, the top module of the instrument holder is formed such that the instrument hoses are guided over the treatment element. The top module can have swivel arms mounted thereon and the instrument holder can have recesses for the accommodation of the instruments. An alternative possibility is to provide, instead of swivel arms, whip arms that are firmly clamped to the top module and, by reason of the elasticity of the material of which they are made, are capable of guiding the hose in the appropriate manner.

Advantageously, the connectors for the supply of media to the instruments can be switched from a position for the attachment of a hanging instrument hose to a position for the attachment of an instrument hose guided over the apparatus. In the first position, the instrument hose extends vertically down and away from the connector, whilst in the second position the connector is horizontal and extends toward the front. The connectors are advantageously accessible on the underside of the base module.

According to a further embodiment, a instrument removal detector is provided, which can be changed from a position for detection of the instruments with hanging instrument hoses to a position for detection of instruments with whip arms or swivel arms, this having the advantage that a single instrument removal detector suffices.

According to another development, the detection of removal can be displaced from the base module to the top module to allow for specific methods of detection. Compared with the equally possible embodiment involving two fixed instrument removal detectors, this has the advantage that only one instrument removal detector need be provided.

According to another development, the base module contains a single instrument removal detector compliant with both types of apparatus. The instrument removal detector is, in a particular embodiment, irremovably mounted.

In another development, the top module is divided into a frame member and an insert, only the insert being constructed according to the type of apparatus required.

BRIEF DESCRIPTION OF THE DRAWINGS

An exemplary embodiment of the invention is illustrated in the drawings.

FIG. 1 depicts a modular treatment element. The treatment element comprises a base module 1 accommodating the electrical and/or hydraulic and/or pneumatic supply media for the instruments. Additionally, couplings 2.1 and 2.2 for instrument hoses 3.1 and 3.2 are provided on the underside.

Figure 1:
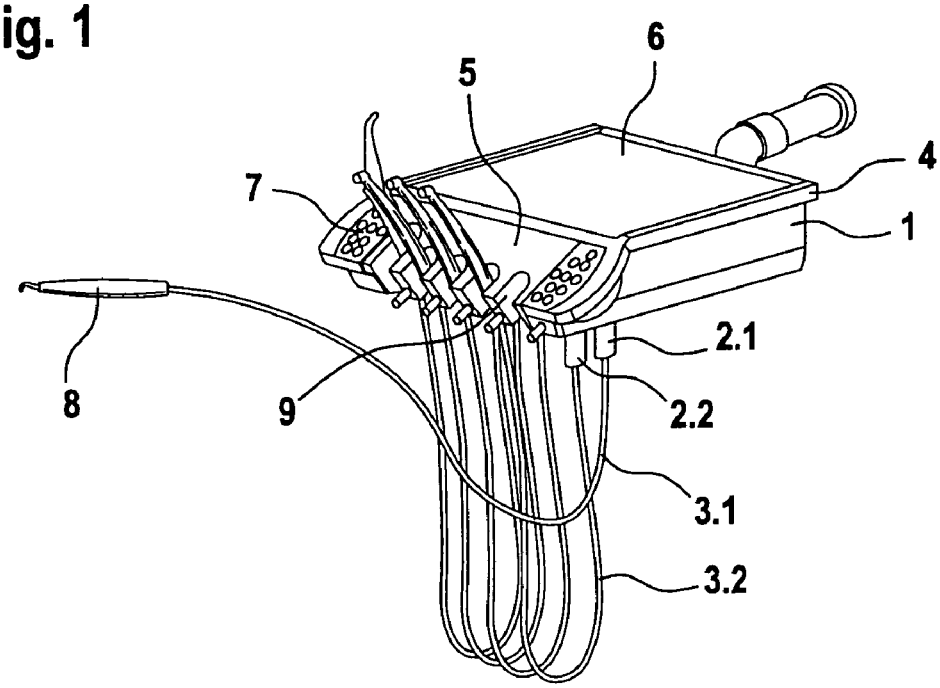
FIG. 1 shows a treatment element having hanging instrument hoses.

On the base module 1 there is mounted a top module 4 which fits over said base module 1. The top module 4 is provided with an instrument holder 5 mounted on the side directed toward the dentist. Extending away from the instrument holder is a flat receptacle 6, on which objects can be placed.

The top module 4 also has a control panel 7, which is connected to the base module 1 via an electrical computer interface (not shown) and which displays information concerning the instrument(s) 8 of significance to the dentist. The control panel 7 is integral with the top module 4 and is disposed in the region of the handles and serves as master control means for the work place.

Alternatively, the control panel 7 can be directly mounted on the base module 1 particularly in the form of a separate control and display unit.

Furthermore, it is possible to combine the instrument holder with the top module so as to give a unitary embodiment. However, a separate instrument holder has the advantage that it can be independently sterilized.

The top module 4 is formed such that it covers the top surface of the base module completely. This provides a construction with no surrounding clear space.

The instrument holder 5 is provided with known types of retainer opening in the form of a docking bay 9, for the accommodation of the instruments. The instrument hoses 3 hang down in a loop below the treatment element and are connected thereto by means of coupling 2.

Figure 2:
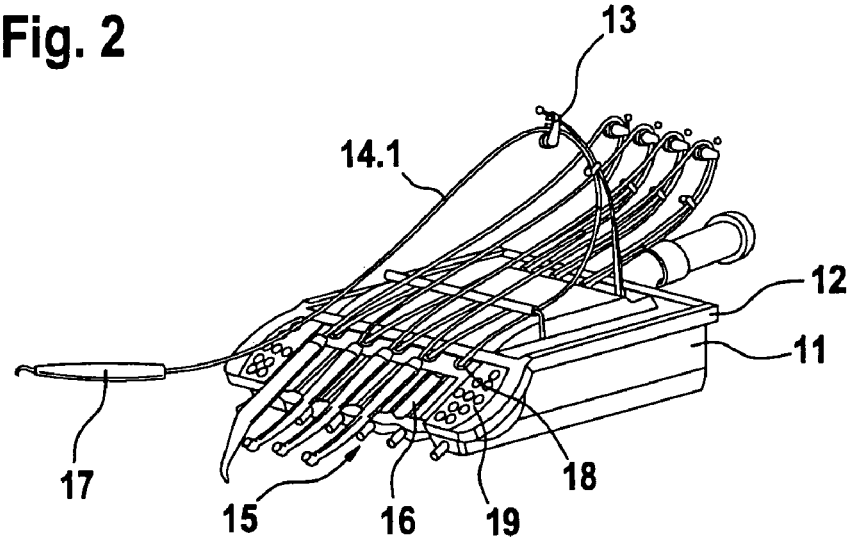
FIG. 2 shows a treatment element having instrument hoses guided over the dentist's element.

FIG. 2 illustrates an embodiment in which the instrument hoses are guided over the treatment element, this embodiment again being based on the base module 11 of FIG. 1 as described above. On this base module 11 there is mounted a top module 12, on which swivel arms and optionally a swivel-arm mechanism are attached for guiding the instrument hoses 14.1. Furthermore, there is provided an instrument holder 15 having docking means for the instrument 17 in the form of a trough 16.

The top module 12 has, in the region of the instrument holder 15, through holes 18, through which the instrument hose 14 is guided to the underside of the base module 11 to be connected to appropriately provided couplings (not shown). The instrument holder 15 is separate from the top module 12 and can be removed therefrom.

In addition, the top module 12 is provided with a control panel 19, which may be equipped with display means, if desired.

Figure 3:
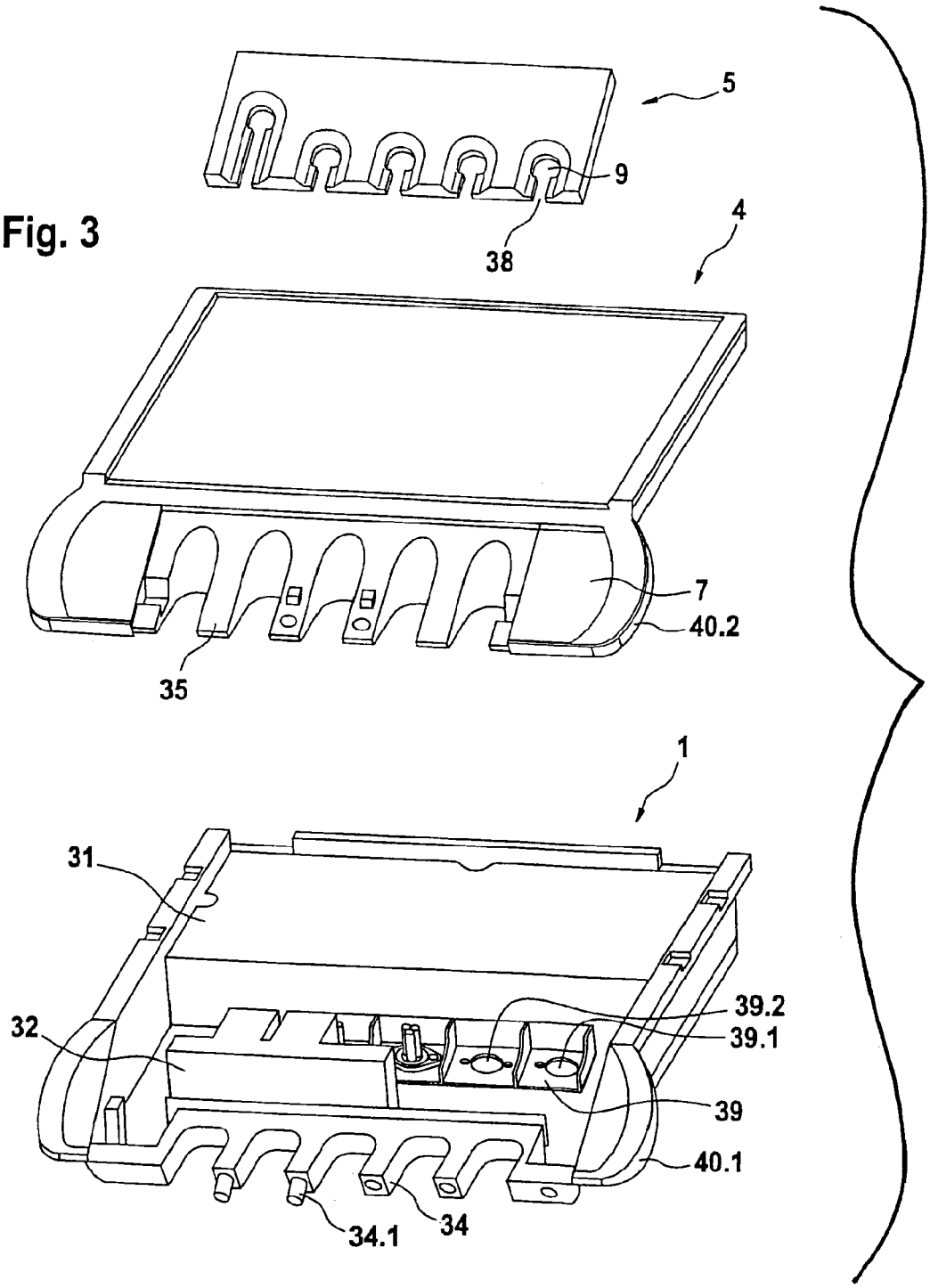
FIG. 3 shows the treatment element according to FIG. 1 in an exploded view.

FIG. 3 is an exploded view of the treatment element of FIG. 1. This illustration shows that the top module 4 is mounted on the base module 1 and covers it completely. The base module 1 accommodates electrical supply means 31 and hydro-pneumatic supply means 32. The top module 4 is provided with a control element 7, which cooperates with the base module 1 via a computer interface (not shown). This can be effected using a cable.

The base module 1 has on its underside (not shown) connectors to which supply hoses (not shown) can be connected.

The front region of the base module 1 has projections 34 designed to accommodate setting elements 34.1 for setting up the instruments, and a supply hose (not shown) is accommodated between these projections 34.

The top module 4 has projections 35 which hide the projections 34 of the base module 1 as viewed from above.

The top module 4 is designed such that a separate instrument holder 5 can be placed on the top module 4, and the instrument holder 5 in turn has docking bays 9 for the accommodation and retention of instruments (not shown).

The docking bays 9 extend at least partially between the projections 35 so that an instrument 1 or its supply hose which is introduced into a docking bay 9 is oriented toward the underside of the base module. The instrument with its supply hose can be removed toward the front through a slit 38 in the docking bay 9, as is usual in the prior art. Such an embodiment is known as an OTP unit.

A supply hose (not shown) is connected to a coupling bar 39, which is accessible from the underside of base module 1. The coupling bar 39 has several couplings 39.1, 39.2 and the alignment thereof can be changed from downwardly directed couplings to forwardly directed couplings.

Figure 4:
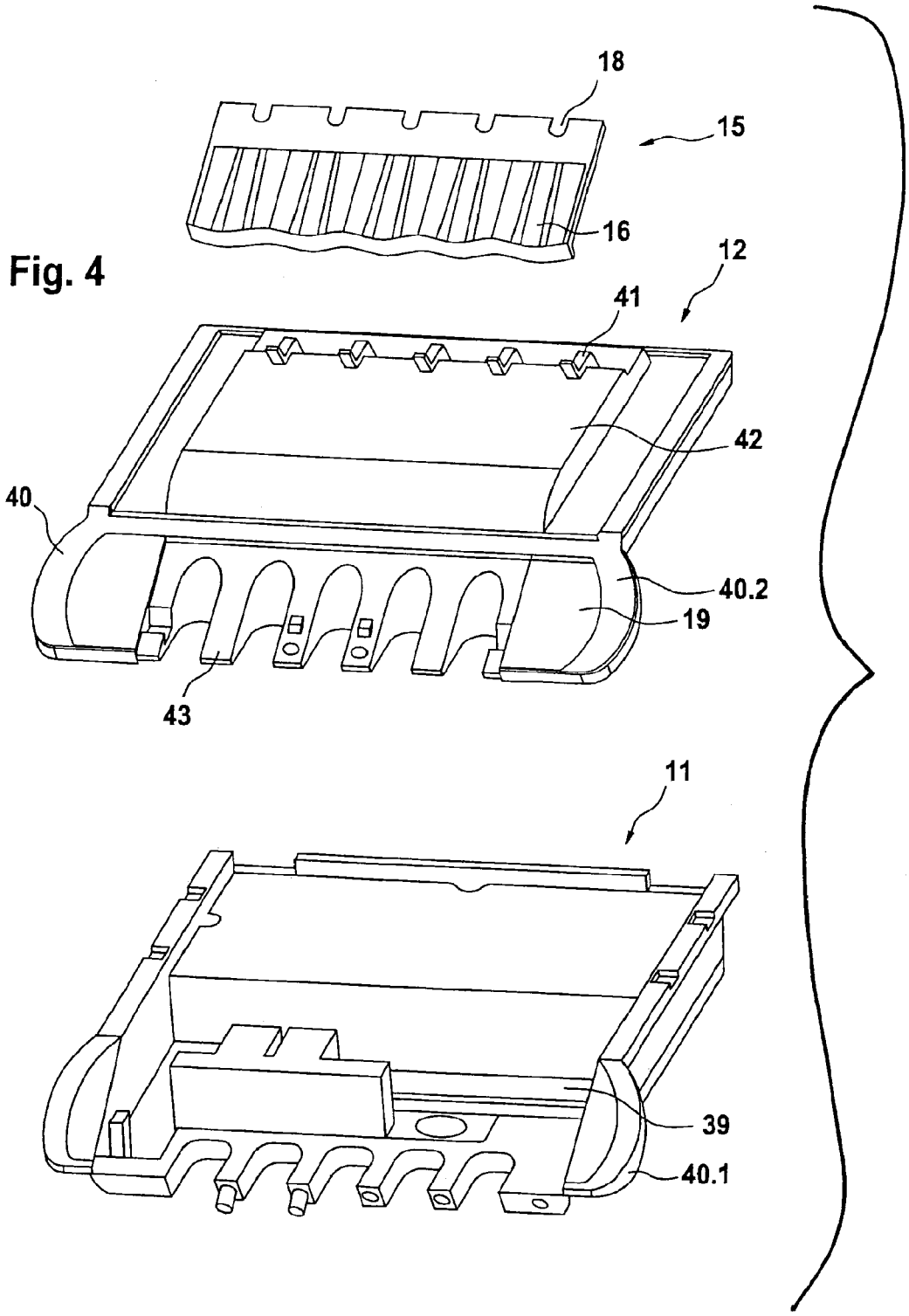
FIG. 4 shows the treatment element according to FIG. 2 in an exploded view.

FIG. 4 is an exploded view of the swivel-arm embodiment according to FIG. 2. The base module disclosed in FIG. 3 is now designated by reference numeral 11 but has the same features as those described with reference to FIG. 3.

The upper surface of the top module 12 is, on the other hand, formed such that attachment means 41 and optionally a mechanism for a swivel arm or whip arm (not shown) are provided. Furthermore, the top side exhibits convexity 42 to improve guidance of the hose. Such structural embodiments are known in the prior art.

The top module 12 is again equipped with a control panel 19 disposed on the side facing the user to the right and to the left in the region of the handles 40 of the treatment element and on each side of a series of projections 43, which are shaped to correspond to the projections 35 on the top module 4 of FIG. 3 and are disposed between the region of the handles 40 and the instrument holder 15.

These projections 43 are covered by an instrument holder 15, but by reason of the recesses 18 an instrument hose (not shown) can be guided from the underside of the base module 1 to its top side in the region of the camber 42.

A sensor unit can be disposed in the region of the trough 16, in order to ascertain whether the instrument is docked or not.

The coupling bar 39 is, compared with the configuration shown in FIG. 3, turned to such an extent that the couplings are directed toward the front of the base module 1. By this means it is possible to position the treatment element directly above the patient.

Figure 5:
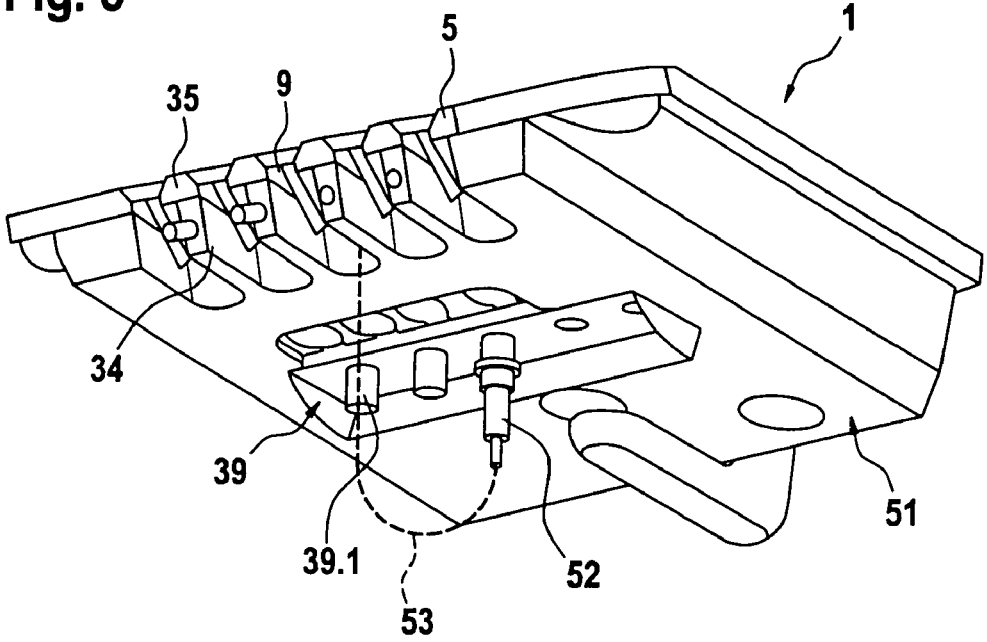
FIG. 5 is a view of the treatment element according to FIG. 1 as seen from below.
Figure 6:
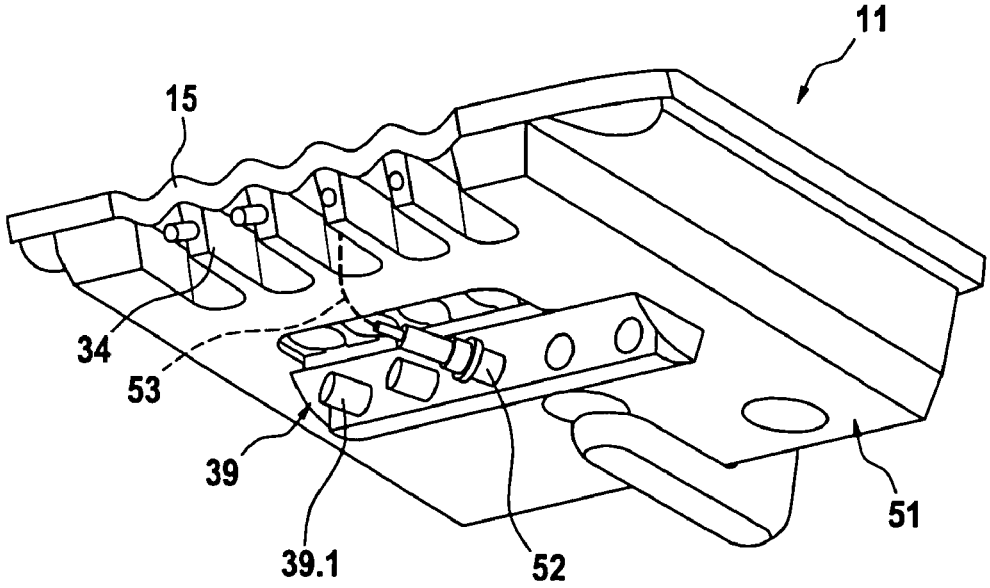
FIG. 6 is a view of the treatment element according to FIG. 2 as seen from below.

These different positions of the coupling bar 39 are illustrated in FIGS. 5 and 6. FIG. 5 shows the base module 1 as seen from below. It can be seen that the coupling bar 39 is provided with downwardly directed couplings 39.1 so that the supply hose 52 illustrated hangs vertically downwardly and is not buckled.

The hanging supply hose 52 is guided as a loop from the underside 51 to an instrument disposed in the docking bay 9 between the projections 34 of the base module 1 and projections 35 of the instrument holder 36 with its docking bays 9, as illustrated by the line 53.

In FIG. 6, the base module 11 of FIG. 4 is shown, coupling bar 39 with its couplings 39.1 and the supply hoses 52 being directed in this case toward the front of the base module 11. The supply hose 52 is guided in this case between the projections 34 and under the instrument holder 15 from the underside 51 of the base module 11 to the top side, as indicated by the dashed line 53.

The coupling bar 39 is either rotatable or is capable of being unplugged and replugged such that it can be moved from the position illustrated in FIG. 5 to that illustrated in FIG. 6.

Figure 7:
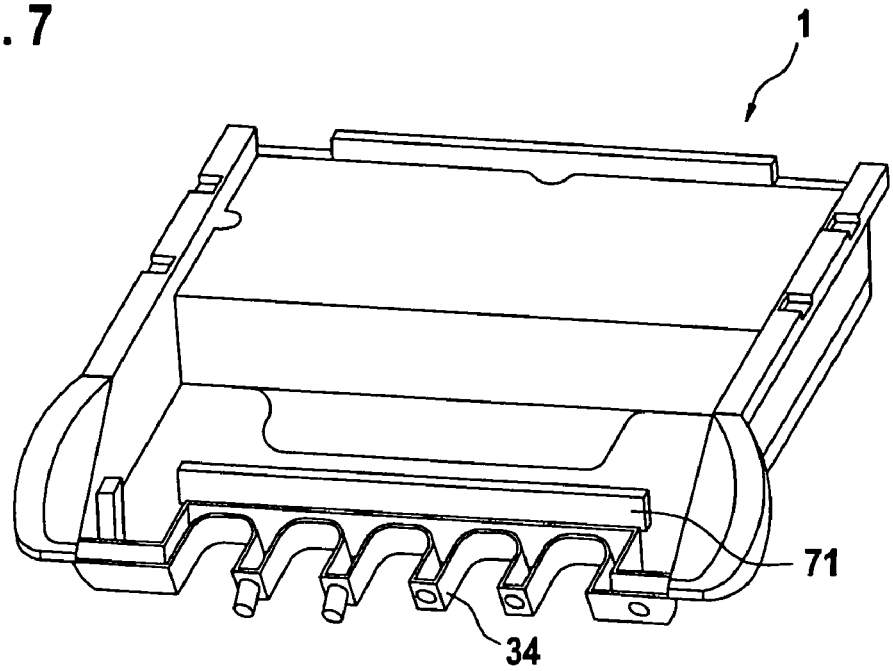
FIG. 7 shows a base module of the treatment element having a sensor configuration in a first mounted position.
Figure 8:
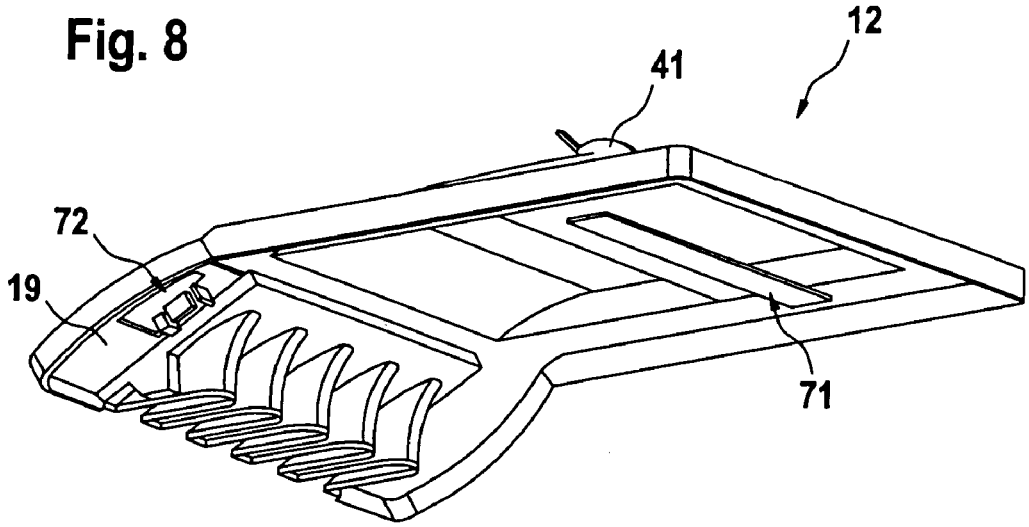
FIG. 8 shows the sensor configuration in a second mounted position on a top module.

Another component that must possibly be unplugged-replugged when modifying the base module is a sensor configuration for detecting the docked instruments, which in FIGS. 7 and 8 is in the form of a light barrier board 71. In FIG. 7, the light barrier board 71 is disposed in the region of the projections 34 in the base module 1. When an instrument is placed between the projections 34, the signal coming from the photoelectric barrier is modified and the resulting change will provide information for determining the presence of the instrument.

In the case of the exemplary embodiment illustrated in FIGS. 2, 4, and 6 and showing the type of treatment element having swivel arms or whip arms, the light barrier board 71 is disposed in the top module 12 such that any modification of the fastening means 41 of the swivel arm will be registered, as illustrated in FIG. 8

FIG. 8 shows, in addition, a pin-and-socket connector 72 for the control panel 19 that is located on the top module 12. Connection with the base module (not shown) is effected via a cable. The light barrier board 71 may also be connected to the base module via a cable.

Figure 9:
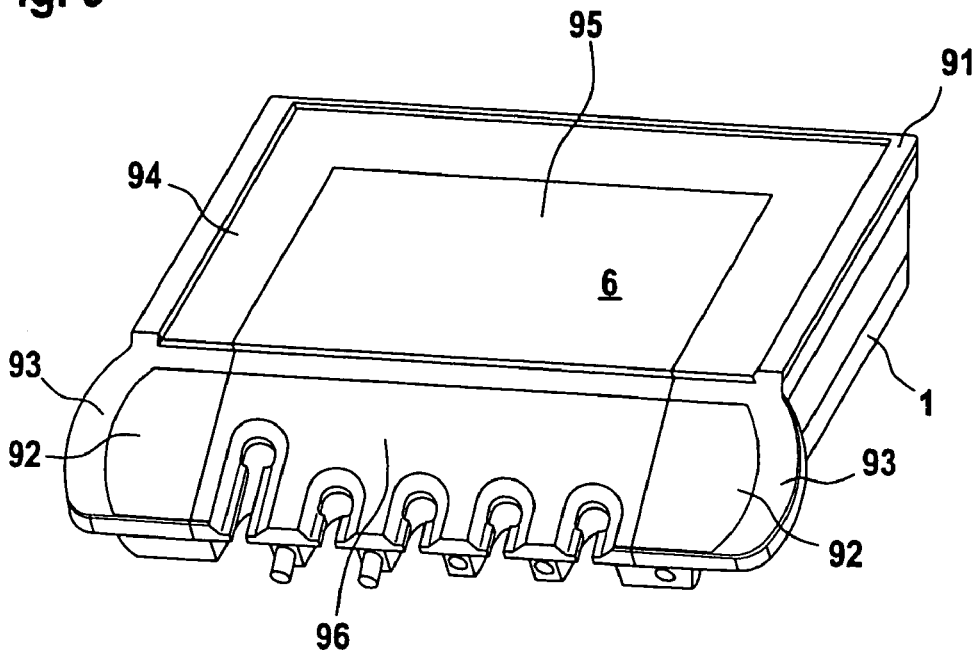
FIG. 9 shows a treatment element having an insert for hanging instrument hoses.
Figure 10:
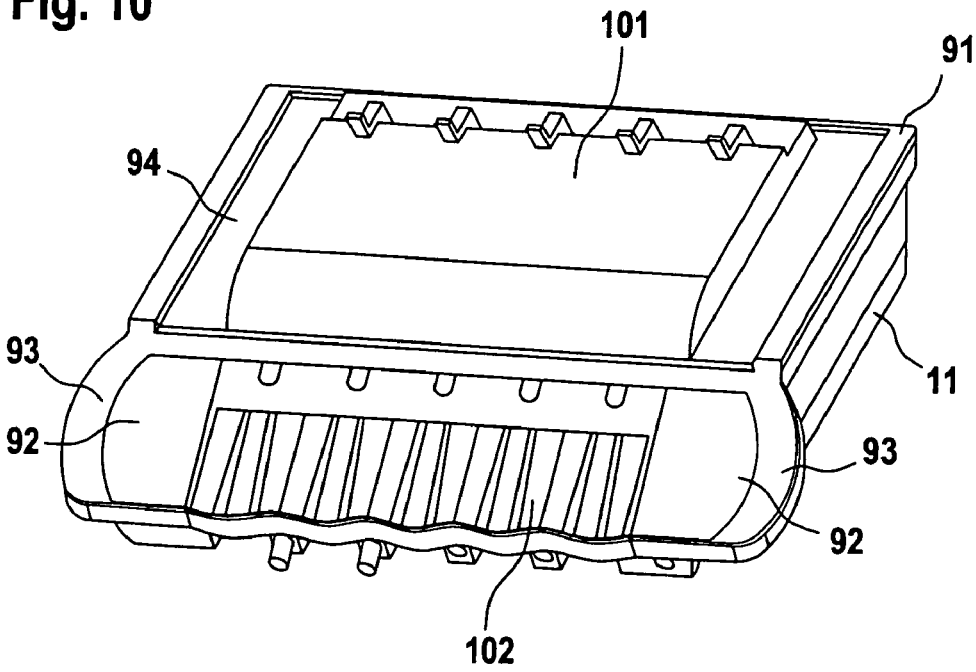
FIG. 10 shows a treatment element having an insert for instrument hoses guided over the treatment element.

FIGS. 9 and 10 show another embodiment of the invention. The base module 1, 11 has on its top surface a frame member 91 which at least partially covers the base module. A control panel 92, a handle 93, and also a marginal area 94 are components common to the various types of apparatus. According to FIG. 9, an insert 95 is placed in the frame member 91 and can, though not necessarily, exhibit a separate instrument holder 96. The insert 95 is formed such that it provides, together with frame member 91, a flat receptacle 6.

In the case of a whip-arm or swivel-arm unit as shown in FIG. 10, an insert 101 is provided which is inserted into the frame member 94 and has a separate instrument holder 102.

In this embodiment, there is a space between the insert 95, 101 and the frame member 91. This space can be cleaned, however, by taking off the insert 95, 101.

The removable instrument holder 96, 102 has, as also in the other exemplary embodiments, the advantage that it can be made of a material that is unaffected by sterilization so that this very frequently used area is sterilizable.

It will be readily appreciated that a uniform base module of the treatment element is provided despite the different types of apparatus. Modification of a swivel-arm unit to give an OTP unit having hanging instrument hoses is carried out by removing the top module, and, in the case of a separate instrument holder on the top module of the whip-arm embodiment shown in FIGS. 2, 4, 6, and 10, it is not necessary to disconnect the instrument hoses from the base module.

Changing a unit having hanging instrument hoses to the swivel-arm or whip-arm embodiment is carried out by first of all removing the instruments from the instrument holder and laying them aside without disconnecting the hoses from the base module. Afterwards, the top module containing the instrument holder is detached from the base module and the top module of the swivel-arm unit is mounted on the base unit. Then, the couplings are shifted from their vertical position to a substantially horizontal position such that the instrument hoses are connected from the front. Electrical connectors are then established.

The instrument hoses are then placed in corresponding recesses of the top module such that they are guided from the underside of the base module to the top surface of the top module. The instrument hoses can then be looped into the swivel arms. The instrument holder is then mounted on the top module so that the reception holes in the top module are closed. The instruments are then placed in the troughs in the instrument holder.

As described with reference to FIGS. 7 and 8, it may be necessary to change a sensor configuration in order to enable different modes of detecting the docked instruments to be realized. The light barrier board according to FIG. 8 registers the motion of a swinging mechanism whereas the light barrier board in the system according to FIG. 7 directly registers the presence of instruments in their docks.

From the above described change-over it will be seen that only a few parts have to be interchanged and that therefore a change can be executed prior to a treatment session without any need to call for a technician.

Furthermore, an essential advantage of such a treatment element is that it is necessary to make only one base device, which will not be expanded to the desired type of apparatus until it is set up on the premises of the final customer to suit the preferred modus operandi of the latter.

Particularly when the respective top modules accommodate all of the special functions and components necessary for the desired type of apparatus, the change-over is readily accomplished and the common base module can be maintained without any alteration.

The invention claimed is:

1. A treatment element for the accommodation of dental hand instruments, comprising a base module having connectors for the supply of media to the instruments, a plurality of top modules including instrument holders, said top modules being interchangeable so that the treatment element can, by changing the top module, be converted from a type of apparatus having hanging instrument hoses into a whip-arm hose support type of apparatus, and a coupling bar mounted on an underside of the base module, said coupling bar including couplings for instrument hoses, said coupling bar being changeably mounted to the base module from a position for the attachment of a hanging instrument hose to a position for the attachment of a hose from in front.

2. The treatment element as defined in claim 1, wherein said top modules can be releasably connected to said base module by hand.

3. The treatment element as defined in claim 1, wherein one of said top modules is equipped with a control panel.

4. The treatment element as defined in claim 1, wherein one of said top modules including instrument holders accommodate instruments having hanging instrument hoses.

5. The treatment element as defined in claim 4, wherein substitute the one of said top modules including instrument holders has a flat receptacle and the instrument has docking bays for holding instruments.

6. The treatment element as defined in claim 1, wherein one of said top modules including instrument holders guide the instrument hoses over the treatment element.

7. The treatment element as defined in claim 6, wherein on the top module there are mounted swivel arms or whip arms and the instrument holder has troughs for the accommodation of the instruments.

8. The treatment element as defined in claim 1, including an instrument removal detector which can be converted from a state for the detection of instruments having hanging instrument hoses to a state for the detection of instruments having swivel-arm or whip-arm hose supports.

9. The treatment element as defined in claim 8, wherein said instrument removal detector can be displaced from said base module to one of said top modules.

10. The treatment element as defined in claim 8, wherein a single instrument removal detector is provided on the base module for use with both instruments having hanging instrument hoses and instruments having swivel-arm or whip-arm hose supports.

11. The treatment element as defined in claim 1, wherein one of said top modules has a frame member and an insert.

12. A dental apparatus which comprises:

a base module which defines a top surface, a bottom surface and a front end, a first top module which is positionable on the top surface of said base module and which defines a flat top surface and a front end which includes a plurality of spaced projections defining hose channels therebetween, a first instrument holder which is positionable on the front end of the first top module and which defines a plurality of docking bays that are in register with said hose channels, a second top module which is positionable on the top surface of said base module and which includes a plurality of swivel-arm hose supports, a second instrument holder which is positionable on the front end of the second top module and provides a plurality of spaced troughs for supporting respective dental instruments, a coupling bar mounted on the bottom surface of the base module and which provides a row of media supply couplings, the coupling bar being oriented such that the media supply couplings extend either downwardly relative to the base module or forwardly relative to the base module, and a plurality of hoses which are respectively connected at first ends to said media supply couplings and at opposite second ends mount respective dental instruments, said coupling bar being oriented so that the media supply couplings will extend downwardly when said first top module with said first instrument holder thereon is positioned on said first top module, and oriented so that the media supply couplings will extend forwardly relative to the base module when the second top module with second instrument holder thereon is positioned on the base module.

13. The dental apparatus as defined in claim 12, wherein said first top module includes a control panel.

14. The dental apparatus as defined in claim 12, including an instrument removal detector which can be converted from a state for the detection of instruments having hanging instrument hoses to a state for the detection of instruments having swivel-arm hose supports.

15. The dental apparatus as defined in claim 14, wherein said instrument removal detector can be displaced from said base module to said top modules.

16. The dental apparatus as defined in claim 14, wherein a single instrument removal detector is provided on the base module for use with said first and second top modules.

17. The dental apparatus as defined in claim 12, wherein said first top module has a frame member and an insert.

* * * * *